US006123533A

United States Patent [19]

McBurnett et al.

[11] Patent Number: 6,123,533

[45] Date of Patent: Sep. 26, 2000

[54] CAVITATION-FREE GEAR PUMP

[75] Inventors: James R. McBurnett, Greer; William D. McMillan, Simpsonville, both of S.C.

[73] Assignee: Dana Corporation, Toledo, Ohio

[21] Appl. No.: 09/041,968

[22] Filed: Mar. 13, 1998

Related U.S. Application Data

[63] Continuation-in-part of application No. 08/837,787, Apr. 22, 1997, abandoned.

[51] Int. Cl.[7] ..... F01C 1/08

[52] U.S. Cl. ..... 418/191

[58] Field of Search ..... 418/191

[56] References Cited

U.S. PATENT DOCUMENTS

| | | |
|---|---|---|
| 171,651 | 1/1876 | Crocker . |
| 1,633,793 | 6/1927 | Porst . |
| 2,601,004 | 6/1952 | Cintron . |
| 2,845,031 | 7/1958 | Guibert . |
| 3,439,625 | 4/1969 | Warne . |
| 3,981,646 | 9/1976 | Bottoms . |
| 4,233,003 | 11/1980 | Jeng . |
| 5,145,349 | 9/1992 | McBurnett . |

FOREIGN PATENT DOCUMENTS

| | | | |
|---|---|---|---|
| 0 301 158 | 2/1989 | European Pat. Off. . | |
| 3205702 | 9/1983 | Germany | 418/191 |
| 1170773 | 11/1969 | United Kingdom . | |
| 1263921 | 2/1972 | United Kingdom . | |
| 1400577 | 7/1975 | United Kingdom . | |

*Primary Examiner*—Thomas Denion
*Assistant Examiner*—Theresa Trieu
*Attorney, Agent, or Firm*—Millen, White, Zelano and Branigan

[57] ABSTRACT

A positive displacement gear pump useful for pumping hydraulic fluid includes a drive gear and an idler gear. In a first embodiment, the drive gear has symmetrical teeth, whereas the idler gear has asymmetrical teeth. The asymmetrical teeth of the idler gear include working surfaces which have a profile corresponding to the profile of the working and non-working surfaces of the drive gear, but have a non-working surface which has been relieved so as to be substantially flat. Consequently, in the zone of the pump where the gears mesh, a large backlash is created which substantially prevents bubble formation. In a second embodiment, the drive gear, as well as the idler gear, have non-contact surfaces which are substantially flat to create even a larger backlash for relieving cavitation when the teeth are made wider in the axial direction. By preventing bubble formation, cavitation which occurs at high pump speeds is substantially eliminated, thus avoiding pump damage which results from cavitation.

13 Claims, 3 Drawing Sheets

CAVITATION-FREE GEAR PUMP

CROSS-REFERENCE TO RELATED APPLICATION

This application is a continuation-in-part of U.S. Pat. Ser. No. 08/837,787, filed Apr. 22, 1997, Abandoned.

FIELD OF THE INVENTION

The present invention relates to gear pumps. More particularly, the present invention relates to cavitation-free gear pumps useful for pumping hydraulic fluid.

BACKGROUND OF THE INVENTION

Gear pumps used for pumping hydraulic fluid utilize a drive gear and an idler gear which mesh proximate inlet and discharge openings of the pump. As the drive gear rotates the idler gear, there is, for each tooth, always a point a contact between the leading flank of the drive gear and trailing flank of the idler gear. Since the point of contact changes for each engagement between a drive tooth and idler tooth, there are really points of contact and, since the teeth have width, the points of contact are actually lines of contact. There is a clearance between the trailing tooth flanks of the drive gear and leading tooth flanks of the idler gear, which clearance is known as "backlash."

As the drive gear and idler gear rotate, hydraulic fluid fills the gap between adjacent teeth and is carried from the inlet, through an adjacent transition zone to the outlet. The fluid adjacent the outlet is prevented from crossing into the meshing area and is forced from the gap between mating teeth and pumped out of the outlet to a discharge line, where it is used to power components in an associated hydraulic circuit. When there is sealing action in the mesh of the teeth and displacement of fluid by a mating tooth, the pump is classified as a "positive displacement gear pump."

Having a relatively large displacement for a given center distance, positive displacement gear pumps experience difficulty filling the spaces between teeth when operated at high speeds. Inadequate filling causes dissolved air to come out of solution which results in entrained air bubbles. Since hydraulic fluid contains approximately 8% dissolved air by weight, the number of air bubbles can be considerable. As the hydraulic fluid is rapidly pressurized in the pump, the bubbles collapse, which results in cavitation damage to the pump in the pressure transition region between inlet pressure and outlet pressure. As the speed of the pump increases and/or as discharge pressure increases, pump damage occurs more quickly and is more intense.

Higher pump speed increases the probability that air will out-gas from the hydraulic fluid while higher pump speed decreases the time spent in the transition zone. In addition, the higher the pressure, the faster the entrained air bubbles collapse. This phenomenon, known as asymmetrical bubble collapse, results in fluid jets of extremely high velocity which cause localized pressure spikes as high as 100,000 psi. When these jets impinge upon surfaces within the gear pump they cause deep pitting over time which damages the pump.

Considering this matter further, bubble formation and subsequent collapse occurs in the region near the mesh as the volume rapidly increases. This is because fluid cannot fill the increasing volume at a sufficient rate which causes a very rapid pressure drop. This creates a vacuum which causes some of the air dissolved in the liquid to come out of solution forming the bubbles. As the bubbles are carried into the inlet cavity, the air pressure increases and the bubbles begin to dissolve back into the fluid. With hydraulic pumps running, at speeds of around 2,150 rpm, there is a rotational velocity of 13° per millisecond. Assuming 120° of rotation, the elapsed time from bubble formation in the mesh region to collapse in the high pressure region is about 9 milliseconds. If the air cannot redissolve in 9 milliseconds, cavitation damage occurs.

Cavitation damage to gear pumps is a problem not only with hydraulic gear pumps, but with other high speed gear pumps as well, such as gear pumps used to pump fuel for aircraft engines.

SUMMARY OF THE INVENTION

It is a feature of the present invention to provide a new and improved gear pump for pumping liquids, wherein cavitation is substantially eliminated.

In accordance with a first embodiment of the invention, a gear pump has a symmetrical drive gear and an asymmetrical idler gear with the non-contact surfaces of the idler gear teeth being relieved and the contact surfaces of both the drive gear and idler gear being arcuate.

In accordance with a second embodiment of the invention, a gear pump for pumping liquids includes a drive gear and an idler gear which is driven by the drive gear. The drive gear, as well as the idler gear, have teeth which are asymmetrical and have working surfaces with convex arcuate profiles and non-working surfaces which are substantially flat as compared to the working surfaces. By making the non-working surfaces of the working and idler gears flat, a large "backlash" is created which prevents bubble formation and, therefore, substantially eliminates cavitation.

In a more specific aspect of the invention, the gears are spur gears and the substantially flat non-working surfaces extend from the top land of each tooth to the root fillet thereof.

In a further aspect, the gear pump is a positive displacement pump and the fluid being pumped is hydraulic fluid with air dissolved therein.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Referring to the figures, there is shown a gear pump 10 which is used to pump hydraulic fluid from a reservoir 12 to a discharge line 14 which is connected to a device such as a hydraulic motor or hydraulic cylinder. The hydraulic fluid pumped by the gear pump 10 contains approximately 8% dissolved air by weight. If this dissolved air is outgassed while being pumped, due to the creation of a vacuum in the tooth space between the gears of the pump, then there is the danger of cavitation damage upon the air being redissolved as the gear pump pressurizes the hydraulic fluid prior to discharge through the discharge line 14. At speeds over 2000 rpm, rotational velocity is about 13° per millisecond, which means that, if bubbles are formed, the elapsed time from bubble formation to collapse is about 9 milliseconds. If the air cannot redissolve in about 9 milliseconds, there will be cavitation damage. The present invention avoids cavitation damage by assuring that the gear pump fills at high speeds.

Figure 1:
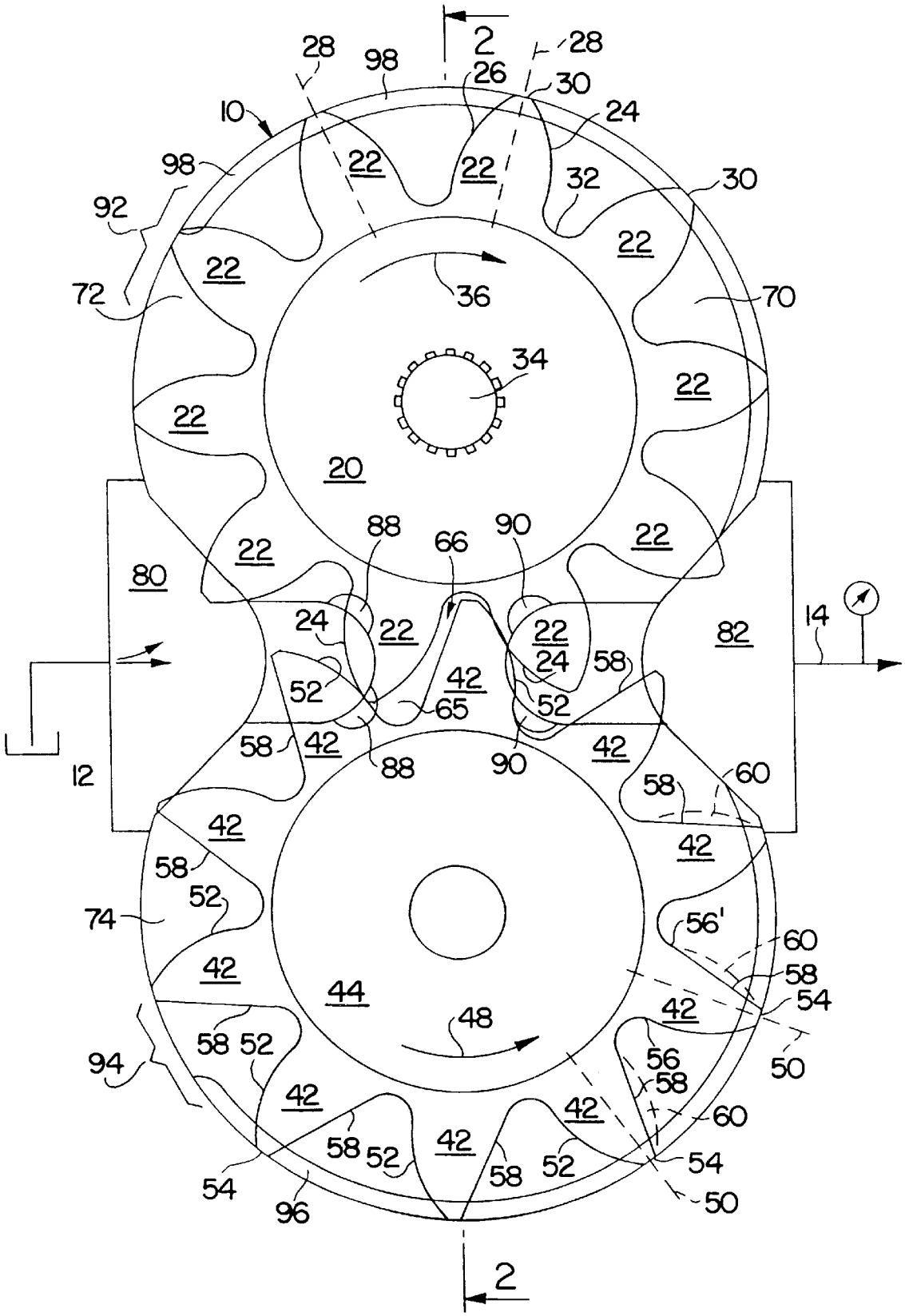
FIG. 1 is a side elevation of a gear pump having a drive gear and idler gear configured in accordance with the principles of a first embodiment of the invention.
Figure 2:
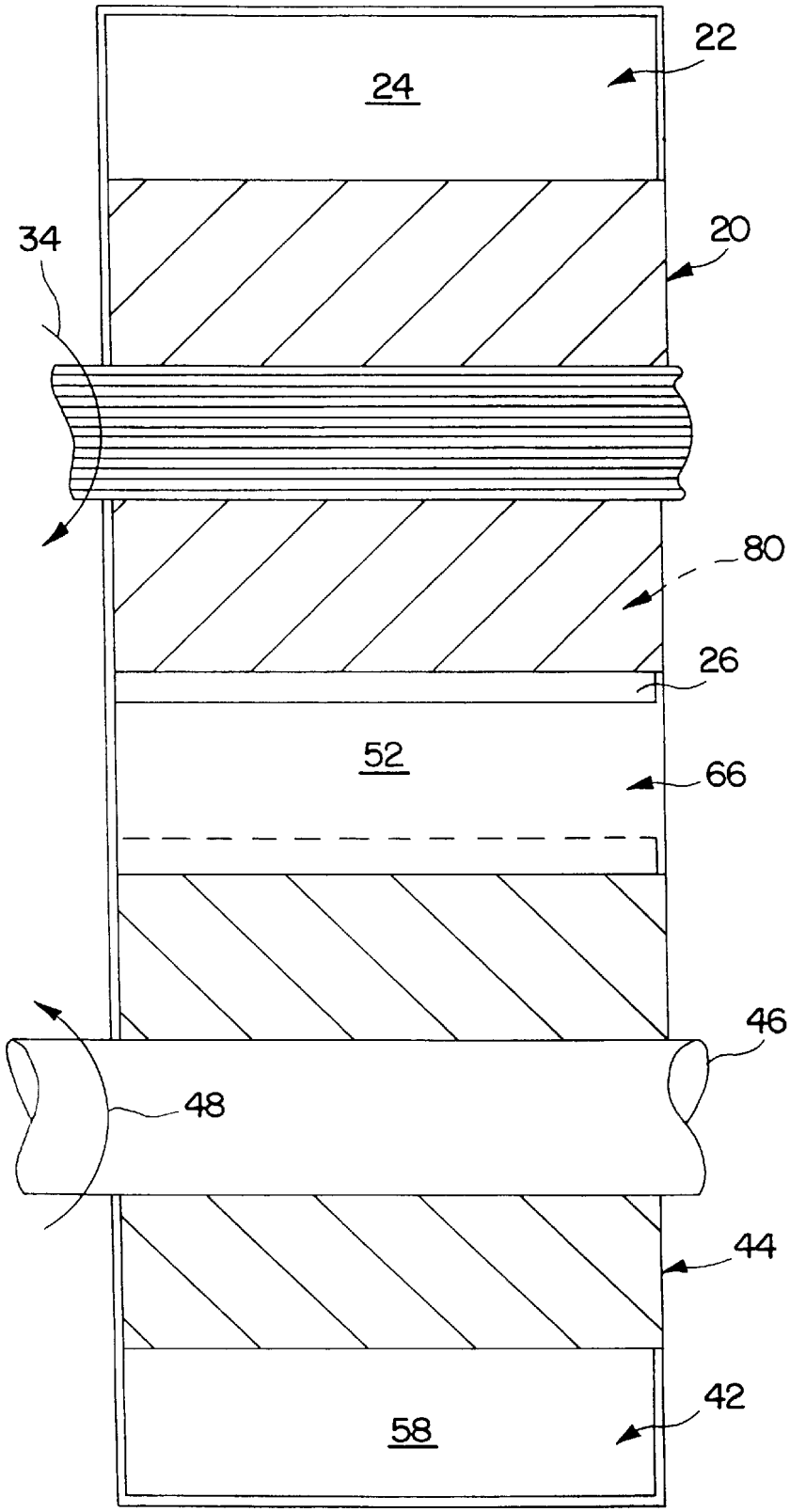
FIG. 2 is a rear elevation of the gear pump of FIG. 1, generally taken along lines 2—2 of FIG. 1, but showing complete tooth surfaces.

First Embodiment - FIGS. 1 and 2

The gear pump 10 includes a drive gear 20 which is in the form of a spur gear having a plurality of involute teeth 22, each having a working surface 24 and a non-working surface 26. Each of the drive teeth 22 is symmetrical about a center line 28 coincident with a radius of the drive gear 20, with the working and non-working faces 24 and 26 being convex from the top land 30 of each tooth to the root fillet 32 of each tooth. The drive gear 20 is driven by a splined shaft 34 to rotate in the direction of arrow 36.

The teeth 22 of the drive gear 20 mesh with the idler teeth 42 of an idler gear 44 which rotates freely on an axle 46 in the direction of arrow 48. The idler teeth 42 are asymmetrical, as opposed to being symmetrical, as is the case with the teeth 22 of the drive gear 20. The asymmetry of each of the idler teeth 42 with is respect to a center line 50 coincident with a radius of the idler gear 44 and is due to the driven working surfaces 52 of each of the idler teeth being convex from the top land 54 of the tooth to the root fillet 56 of the tooth but the non-working idler surface 58 of each idler tooth being substantially flat from the top land 54 to the root fillet 56'. In other words, each of the non-working idler surfaces 58, in essence, is formed by deleting or removing a convex profile portion 60 (shown in dotted lines) of each idler tooth 42 which, in prior art positive displacement gear pumps, is present. The result of deleting the convex portion 60 from each of the idler gear teeth 42 is that a large backlash 65 is created at the zone 66 where the idler gear teeth 42 mesh with the drive gear teeth 22, when the drive gear working surfaces 24 contact the idler gear working surfaces 52.

The gear pump 10 encases the drive gear 20 and idler gear 44 in a housing 70 which includes a first chamber 72 that houses the drive gear 20 and a second chamber 74 that houses the idler gear 44. Aligned with the mesh zone 66 is an inlet cavity 80 and an outlet cavity 82 that are connected via inlet and outlet openings 84 and 86 to the mesh zone 66. Formed adjacent the cavities 84 and 86 are an inlet side trap release 88 and outlet side trap release 90.

The first chamber 72 of the housing 70 defines a transition zone 92 from low pressure to high pressure while the second chamber 74 of the housing 70 defines a transition zone 94 from low pressure to high pressure. Starting from within the transition zones 92 and 94, are grooves 96 and 98 which provide a pressure balancing function, as is set forth in U.S. Pat. No. 5,145,349, incorporated herein by reference.

In the prior art, air bubbles form at the location corresponding to applicants' large backlash 65, when the positive displacement pump 10 is running at high speed. When these bubbles collapse at the transition zones 92 and 94, the resulting high pressures pit the gear teeth, and surfaces of the first and second chambers 72 and 74 of the housing 70. In the present invention, no bubbles are formed, due to the large backlash 65 and, consequently, there are no bubbles to collapse at the transition zones 92 and 94.

Figure 3:
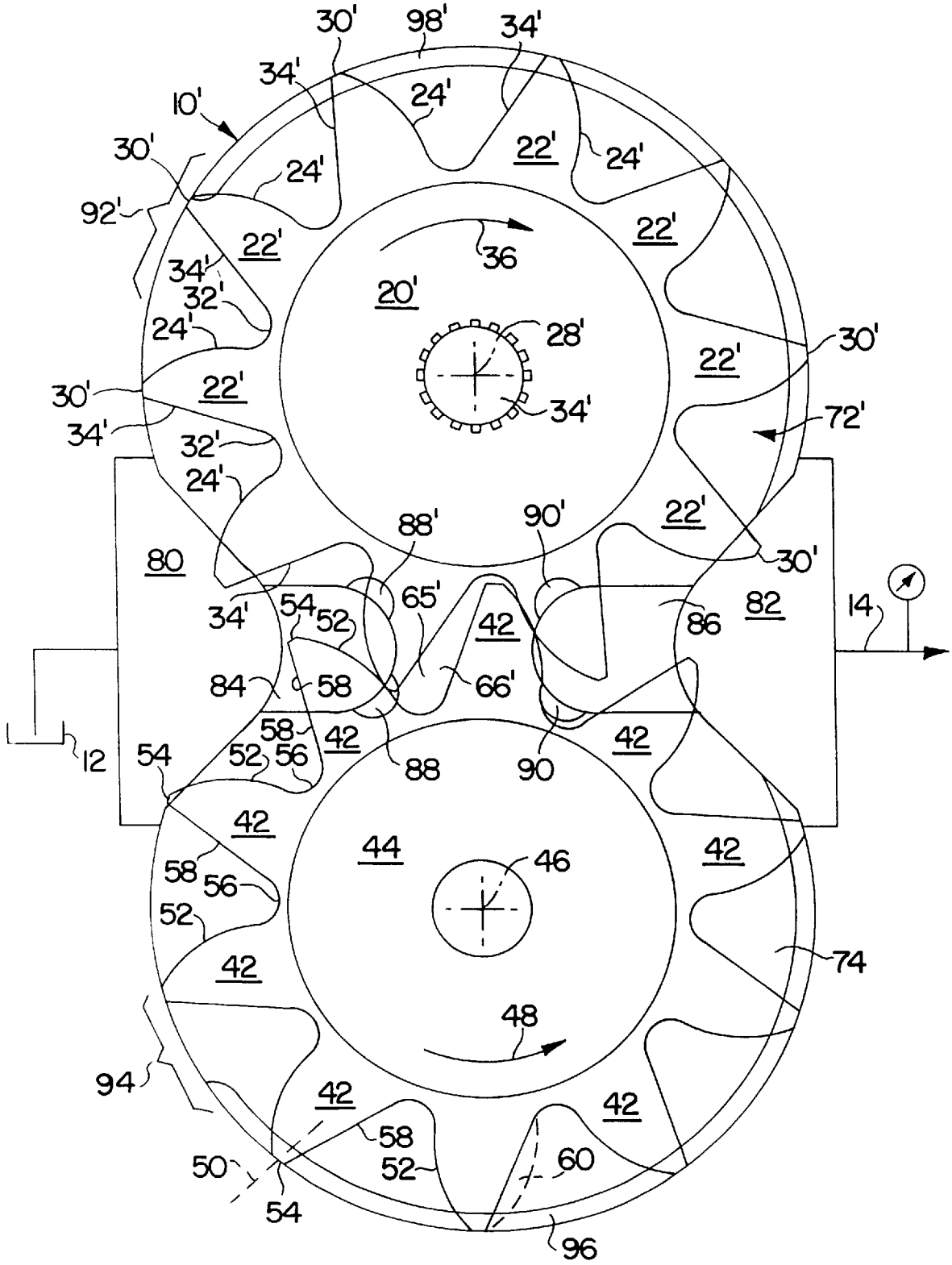
FIG. 3 is a side elevation of a second embodiment of the present invention, wherein both the drive gear and idler gear have flat non-contact surfaces.

Second Embodiment - FIG. 3

The gear pump 10' includes a drive gear 20' which is in the form of a spur gear having a plurality of involute teeth 22', each having a working surface 24' and a non-working surface 26'. The drive teeth of the pump 10' are asymmetrical about a center line 28' coincident with a radius of the drive gear 20', with the working faces 24' convex from the top land 30' of each tooth to the root fillet 32' of each tooth and with the non-working surfaces 26' being flat from the top land 30' to the root fillet 32 of each tooth. The drive gear 20' is driven by a splined shaft 34' to rotate in the direction of arrow 36'.

The teeth 22' of the drive gear 20' mesh with the idler teeth 42 of the idler gear 34 which is identical with the idler gear of FIGS. 1 and 2 and which rotates freely on an axle 46 in the direction of arrow 48. The idler teeth 42 are asymmetrical, as are the teeth 22' of the drive gear 20'. Like the non-contact surfaces of the drive gear teeth 22', the asymmetry of each of the idler teeth 42 with respect to a center line 50 coincident with a radius of the idler gear 44 and is due to the driven working surfaces 52 of each of the idler teeth being convex from the top land 54 of the tooth to the root fillet 56 of the tooth, but the non-working idler surface 58 of each idler tooth being substantially flat from the top land 54 to the root fillet 56. In other words, each of the non-working idler surfaces 58, in essence, is formed by deleting or removing a convex profile portion of each idler tooth 42 which, in prior art positive displacement gear pumps, is present. As a result of deleting the convex portion from each of the idler gear teeth 42 and each of the drive gear teeth 22', a larger backlash 65' is created at the zone 66' where the idler gear teeth 42 mesh with the drive gear teeth 22', when the drive gear working surfaces 24' contact the idler gear working surfaces 52. It has been found that as the width of the teeth 22 and 42 increase, it is necessary to relieve the drive gear teeth, as well as the idler gear teeth so as to provide the larger backlash zone 65.

The gear pump 10 encases the drive gear 20' and the idler gear 44 in a housing 70 which includes a first chamber 72' that houses the drive gear 20' and a second chamber 74 that houses the idler gear 44. Aligned with the mesh zone 66 is an inlet cavity 80 and an outlet cavity 82 that are connected via inlet and outlet openings 84 and 86 to the mesh zone 66'. Formed adjacent the cavities 84 and 86 are an inlet side trap release 88 and an outlet side trap release 90.

The housing 72 defines a transition zone 92' from low pressure to high pressure while the housing 74 defines a transition zone 94 from low pressure to high pressure. Starting from within the transition zones 92' and 94, are grooves 96 and 98' which provide a pressure balancing function, as is set forth in U.S. Pat. No. 5,145,349, incorporated herein by reference.

In the prior art, air bubbles form at the location corresponding to applicants' larger backlash 65', when the positive displacement pump 10' is running at high speed. When these bubbles collapse at the transition zones 92' and 94, the resulting high pressures pit the gear teeth, and surfaces of the housings 72' and 74. In the present invention, no bubbles are formed, due to the large backlash 65' and, consequently, there are no bubbles to collapse at the transition zones 92' and 94.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a gear pump for pumping liquids having dissolved air therein with meshed gears from an input to an output, the improvement comprising:

a pump housing having surfaces;

a drive gear within the pump housing having a plurality of symmetrical driving gear teeth, wherein each symmetrical driving gear tooth has a driving working surface and a non-working surface, each of the tooth surfaces have an arcuate profile; and an idler gear within the pump housing having a plurality of asymmetrical idler gear teeth, wherein each asymmetrical idler gear tooth has a driven working surface contacted by the driving working surface of a complementary symmetrical drive gear tooth and a non-working idler surface, the driven working surface having an arcuate profile similar to the actuate profile of the driving working surfaces and the non-working idler surface having profile less convex than that of the other surfaces for preventing damage to the surfaces by increasing backlash so that the formation of air bubbles is precluded and localized pressure spikes which cause pitting are avoided.

2. The improvement of claim 1, wherein the idler surface is substantially flat.

3. The improvement of claim 1, wherein each gear tooth has a top land and a root fillet and wherein the idler surface is substantially flat from the top land to the root fillet.

4. The improvement of claim 3, wherein the drive gear and idler gears are spur gears.

5. The improvement of claim 1, wherein the drive gear and idler gears are spur gears.

6. The improvement of claim 1, wherein the gear pump is a positive displacement pump.

7. The improvement of claim 1, wherein the pump is a positive displacement pump and wherein the liquid is hydraulic fluid.

8. A gear pump for pumping liquids having dissolved air, wherein the gear pump comprises a drive gear and an idler gear within a housing having surfaces, wherein the drive gear has teeth which are symmetrical and have working and non-working idler surfaces with arcuate profiles and wherein the idler gear has asymmetrical teeth with working surfaces corresponding in shape to the working surfaces of the drive gear and non-working surfaces which are relieved, as compared to both the working and non-working surfaces of the drive gear for preventing damage to the surfaces by increasing backlash so that formation of air bubbles is precluded and localized pressure spikes which cause pitting are avoided.

9. The gear pump of claim 8, wherein the non-working surfaces of the idler gear are substantially flat.

10. The gear pump of claim 9, wherein the liquid is hydraulic fluid containing about 8% dissolved air.

11. The gear pump of claim 8, wherein the liquid is hydraulic fluid containing about 8% dissolved air.

12. The gear pump of claim 11, wherein the gears are spur gears.

13. The gear pump of claim 8, wherein the gears are spur gears.

* * * * *